US005415398A

United States Patent [19]

Eggiman

[11] Patent Number: 5,415,398

[45] Date of Patent: May 16, 1995

[54] SOFTBALL BAT

[76] Inventor: Michael D. Eggiman, 31155 NW. Milne St., Hillsboro, Oreg. 97124

[21] Appl. No.: 257,943

[22] Filed: Jun. 10, 1994

Related U.S. Application Data

[63] Continuation of Ser. No. 62,307, May 14, 1993, abandoned.

[51] Int. Cl.[6] ..... A63B 59/06

[52] U.S. Cl. ..... 273/72 A

[58] Field of Search ..... 273/67 R, 72 A, 72 R, 273/268, 73 R

[56] References Cited

U.S. PATENT DOCUMENTS

| | | | |
|---|---|---|---|
| 3,116,926 | 1/1964 | Owen et al. | 273/72 |
| 3,861,682 | 1/1975 | Fujii | 273/72 |
| 3,876,204 | 4/1975 | Moore et al. | 273/72 |
| 3,963,239 | 6/1976 | Fujii | 273/72 |
| 4,056,267 | 11/1977 | Krieger | 273/72 A |
| 4,113,248 | 9/1978 | Yanagioka | 273/72 A |
| 4,569,521 | 2/1986 | Mueller | 273/72 |
| 4,600,193 | 7/1986 | Merritt | 273/72 A |
| 4,951,948 | 8/1990 | Peng | 273/72 A |
| 4,961,576 | 10/1990 | Meredith | 273/72 |
| 5,094,453 | 3/1992 | Douglas et al. | 273/72 |
| 5,104,123 | 4/1992 | Okitsu et al. | 273/72 |
| 5,131,651 | 7/1992 | You | 273/72 |
| 5,180,163 | 1/1993 | Lanctot | 273/72 A |
| 5,219,164 | 6/1993 | Peng | 273/72 A |

FOREIGN PATENT DOCUMENTS

| | | | |
|---|---|---|---|
| 4303477 | 10/1992 | Japan | 273/72 A |
| 2247932 | 3/1992 | United Kingdom | 273/72 R |

*Primary Examiner*—Mark S. Graham
*Attorney, Agent, or Firm*—Klarquist Sparkman Campbell Leigh & Whinston

[57] ABSTRACT

A tubular aluminum bat frame is provided with a large-diameter impact portion, an intermediate tapering portion, and a small-diameter handle portion. A tubular insert is suspended within the impact portion by interference fits at each insert end. A first interference fit is achieved by forcing the first end of the insert into the tapering portion of the bat frame. The second interference-fit is then formed by curling the end of the impact portion over upon the second end of the insert. A gap exists along the length of the suspended insert separating the insert from the interior of the impact portion. The gap is filled with grease to facilitate relative movement between the insert and the tubular frame when a ball is batted.

18 Claims, 1 Drawing Sheet

SOFTBALL BAT

This application is a continuation of application Ser. No. 08/062,307, abandoned, filed on May 14, 1993.

FIELD OF THE INVENTION

The present invention relates to softball and baseball bats and more particularly relates to the use of structural members inside such bats to improve their impact response.

BACKGROUND AND SUMMARY OF THE INVENTION

Tubular metallic softball (and baseball) bats are well known in the art. A familiar example is a tubular aluminum bat. Such bats have the advantage of a generally good impact response, meaning that the bat effectively transfers power to a batted ball. This effective power transfer results in ball players achieving good "slugging" distances with batted balls. An additional advantage of such aluminum bats is the improved durability over crack-prone wooden bats.

Even though today's aluminum bats perform well, there is an ever-continuing quest for bats with a better "slugging" capacity. Accordingly, one important need is to optimize the impact response of a bat. Generally speaking, impact response is best when a bat undergoes a greatest elastic deflection, before rebounding with a greatest force in the shortest amount of time. Optimization of these three factors increases the "spring" of a ball off a bat, yielding a bat with a superior power transfer and facility for "slugging."

Constraining the design of aluminum bats is the requirement that the elastic deflection not be accompanied by any plastic deformation. Plastic deflection lessens the power transfer to a ball and leaves the bat permanently dented. Thus, aluminum bat design is driven by the elastic and plastic deformation characteristics of aluminum. For example, when the tubular wall is too thin, a desirable large amount of elastic deflection is achieved, but with unwanted permanent plastic deformation. On the other hand, when the aluminum tubular wall is too thick, the bat may be too stiff to elastically deflect appreciably. In this case, the bat responds with relatively little spring, resulting in lower power transfer.

To provide for greater "spring," tubular bats using other materials, such as titanium, have been developed. Titanium is a high-strength material permitting thin bat frame walls which provide a substantial elastic deflection without plastic deformation. Such bats provide excellent spring-like response and power transfer to a batted ball. However, the material cost and difficulty of working titanium result in a high consumer cost.

The prior art also includes tubular bats using inserts. While most often inserts are used for vibration deadening purposes, U.S. Pat. No. 3,963,239 of Fujii discloses a metallic bat frame with a large-diameter impact portion receiving an insert to adjust the weight and improve the "repelling action" of the bat. Fujii teaches an insert in tight abutment within the tubular frame, so that the insert is fixed relative to the frame. The engagement is improved by forcing the insert into the tapered intermediate portion of the bat and/or by gluing the insert within the frame. The tightly-fitted Fujii insert simply acts to thicken the wall of the impact portion of the bat.

In light of the shortcomings of the prior art, it is an objective of the present invention to provide an improved bat.

It is another objective of this invention to provide a bat that increases the power transferred from the bat to a batted ball.

It is yet another objective of this invention to provide a simple construction for a tubular bat with an insert.

In accordance with a preferred embodiment of the present invention, a tubular aluminum bat frame is provided with a large-diameter impact portion, an intermediate tapering portion, and a small-diameter handle portion. A tubular insert is suspended within the impact portion by interference fits at each insert end. A first interference fit is achieved by forcing the first end of the insert into the tapering portion of the bat frame. The second interference-fit is then formed by curling the end of the impact portion over upon the second end of the insert. A gap exists along the length of the suspended insert separating the insert from the interior of the impact portion. The gap is filled with grease to facilitate relative movement between the insert and the tubular frame when a ball is batted.

The foregoing and additional features and advantages of the present invention will be more readily apparent from the following detailed description, which proceeds with reference to the accompanying drawings.

DETAILED DESCRIPTION

Figure 1:
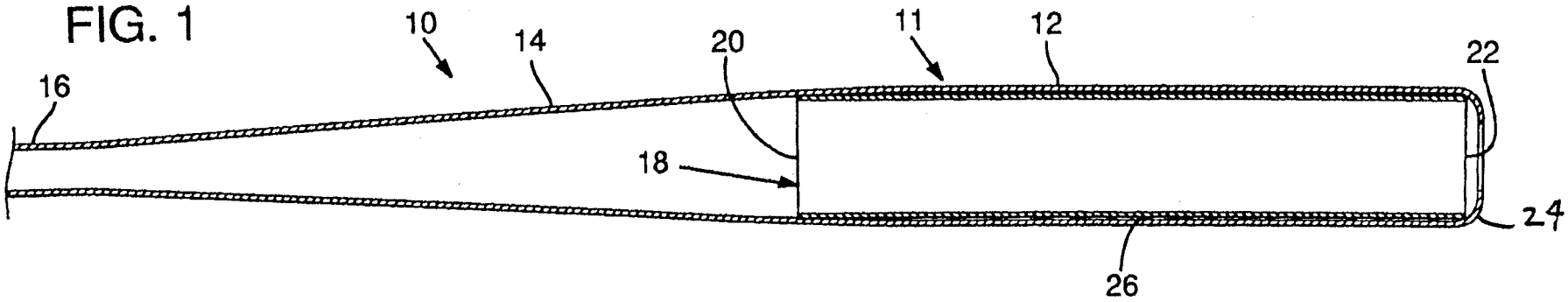
FIG. 1 shows a sectional view through the center of a softball bat in accordance with one aspect of this invention.

Referring to FIG. 1, a softball bat 10, according to one embodiment of the present invention, has a tubular aluminum frame 11 with a relatively large-diameter impact portion 12, an intermediate tapering portion 14, and a relatively small-diameter handle portion 16.

To provide for an improved impact response yielding a better transfer of power from the bat to a batted ball, a tubular insert 18 is suspended within the impact portion 12 of the tubular frame. The tubular insert is a hollow tube of an outer diameter slightly less than the inner diameter of the tubular frame impact portion 12. A first end 20 of the tubular insert 18 is inserted through the impact portion 12 to be forcefully lodged in abutment with the diametrically narrowing interior wall of the tapering portion 14, thus forming a first interference fit. A second end 22 of the tubular insert 18 is spaced inwardly from the top end of the impact portion 12 when the tubular insert 18 is secured in the first interference fit. A second interference fit is created at the insert second end 22 by curling the topmost portion of the impact portion over upon the insert second end 22. The curled-over portion forms a reduced-diameter head portion 24 of the tubular frame 11.

Figure 3:
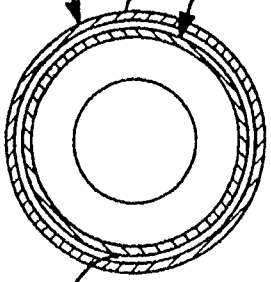
FIG. 3 is a sectional view taken along line 3—3 of FIG. 2.

Because the outer diameter of the insert 18 is slightly less than the inner diameter of the tubular frame impact portion 12, the suspended insert 18 contacts the tubular frame only at the interference fits of the first and second insert ends 20, 22. A narrow, uniform gap 26 exists between the insert 18 and the inner wall of the impact portion 12. The gap extends uniformly around the insert (see FIG. 3) and along the length of the insert between the first and second ends 20, 22 thereof.

Figure 2:
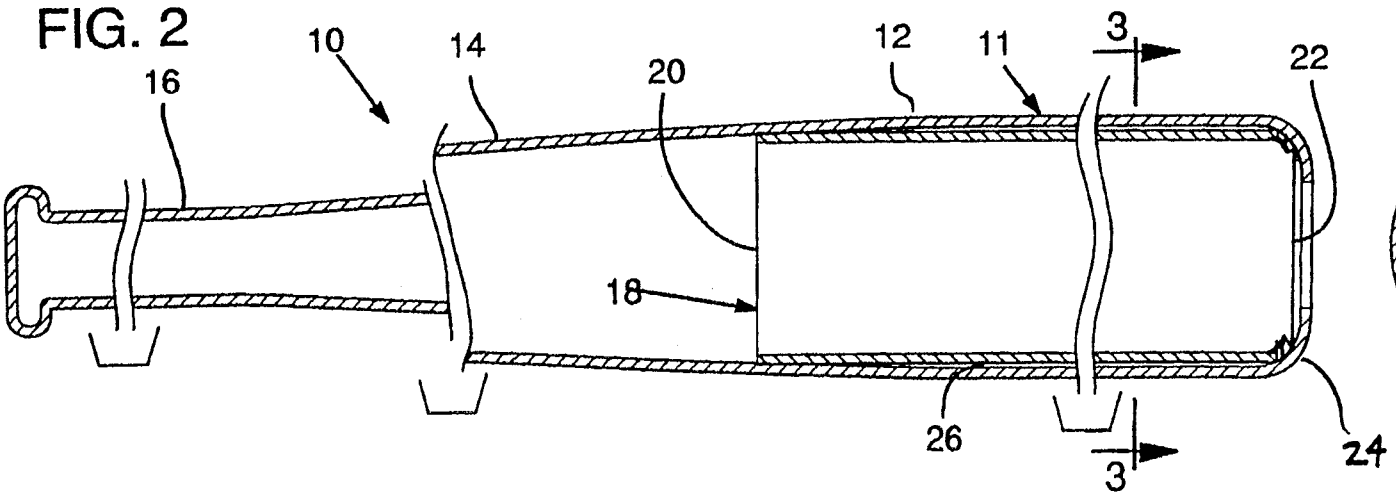
FIG. 2 is a magnified cutaway view of the bat of FIG. 1.

As best seen in FIG. 2, the gap 26 is filled with a lubricant, such as grease. The grease is brought within the gap 26 by coating the insert 18 with grease before the insert is inserted into the tubular frame 11. Once the insert 18 is secured between the first and second interference fits, the lubricant-filled gap 26 is effectively sealed by the first and second interference fits.

The operation of the softball bat of the illustrated embodiment is designed for an improved transfer of power to a batted ball. Specifically, the bat 10 responds to the impact with a ball by providing a large elastic deflection, which rebounds with a large force in a short amount of time.

The tubular frame 11 with the suspended insert 18 attached at both ends to the tubular frame 11 yields a mechanical system with characteristics similar to a leaf spring. When the bat 10 strikes a ball on the impact portion 12, the impact portion 12 wall deflects inwardly through the grease-filled gap 26 to load and inwardly deflect the underlying insert wall. The deflection of the impact portion 12 can be considered as generally arcuate. Accordingly, the insert 18 deflects arcuately to cradle the arcuate deflection of the impact portion 12.

Because the insert 18 arcuate cradles the impact portion 12 arcuate, the insert 18 arcuate has a radius of curvature greater than the impact portion 12 arcuate. Because the insert 18 is fixed within the tubular frame at the insert ends 20, 22, the greater radius of curvature of the insert deflection causes the insert 18 to be stretched, as well as bent, around the deflection of the impact portion 12. Therefore, the insert 18 undergoes substantial tensile, as well as bending stress when a ball is batted.

The leaf-spring-like attachment of the insert 18 within the impact portion 12 provides a rebound to yield improved power transmission to the ball. The bending stresses are released as the walls of the impact portion 12 and the insert 18 rebound into the unloaded state. The tensile loading of the underlying insert wall is released simultaneously, adding "snap" which increases the force and velocity of the rebound. Accordingly, the extra snap owing to the leaf-spring-like suspension of the insert 18 within the tubular frame yields an improved transfer of power to the batted ball, and a heightened "slugging" capacity for the bat.

The grease permits relative movement between the impact portion 12 and the insert 18, so that the insert can independently stretch around the deflection of the impact portion 12. The sealed condition of the grease within the gap offers another advantage. The impact with a ball may occur so rapidly that the grease cannot appreciably flow. Rather, the grease hydrostatically supports the wall of the impact portion away from the insert. In this case, a substantial layer of grease is maintained between the impact portion and the insert, facilitating the movement of the insert relative to the impact portion. In another aspect, any flow of the grease that does occur during impact serves to distribute the force of impact over an expanded area of the impact portion 12. The distribution of the impact stress permits a thinner-walled impact portion because high stress concentrations causing plastic deformation are not likely to occur.

In a preferred embodiment, both the tubular frame and the insert are made of aluminum. An exemplary construction of the bat has the tubular frame 11 swaged from a constant-diameter aluminum tube to yield an integral, weld-free frame. Such swaging results in a tubular frame with thinner walls at the impact portion 10 and thicker walls at the handle portion 16. While swaging is used to produce the tubular frame 11 of the illustrated embodiment, it shall be understood that other methods of manufacturing the tubular frame may work equally as well.

Using aluminum of 80,000 pounds/inch$^2$ yield strength, an excellent batting response is achieved when the impact portion 12 is about 13 inches long with a wall thickness of 0.058 inch. An insert 18 slightly shorter than the impact portion 12 and having a wall thickness of 0.048 inch is inserted into the impact portion 12. The outer diameter of the insert is chosen so that the gap between the outer surface of the insert 18 and the inner surface of the impact portion 12 is about 0.007 inch.

While such dimensions yield excellent results, it is to be understood that they are exemplary only, and that many permutations of bat frame, insert, and gap dimensions will work equally as well. All permutations of component dimensions and configurations fall within the scope of the present invention.

Further describing a preferred construction, the insert 18 is coated with the lubricant before being inserted into the tubular frame 11. The first end 20 of the insert 18 is forcefully inserted into the tapering portion to achieve a tight interference fit. Plastic deformation of the aluminum insert at the interference fit increases the tightness of the attachment and the seal. The second interference fit is then obtained within a frame head portion 24, which is formed by curling the topmost end of the impact portion 12 over upon the insert second end 22. It has been found that a tight fit is achieved by curling in a one-half-inch radius forcefully enough to cause some plastic deformation in the insert second end 22. The curling may be facilitated by locally heating the end of the impact portion.

It should be understood that the foregoing is exemplary only, and that equally good results can be achieved without heating, curling, or plastic deformation of the insert ends. For instance, the head portion 24 of the frame could be pre-formed and threaded into the top of the impact portion 12. In this case, the head portion 24 may be threaded to impinge tightly upon the insert second end 22, to create the interference fit.

The interference fits of the illustrated embodiment offer excellent performance and are advantageous in the simplicity of design and manufacture (notably in the absence of any required welding). However, it is to be understood that welding or other fasteners may also be used. For instance, additional friction-improving devices may be used at the interference fits of the inserts and the tubular frame 11. Alternatively, adhesives or mechanical fasteners for joining the insert ends to the tubular frame may be used. Any fastener may also serve the purpose of sealing the lubricant within the gap 26. Any attachment mechanism or fastener maintaining the leaf-spring-like suspension falls within the scope of the present invention.

While the present embodiment utilizes aluminum for the frame and the insert, it should be understood that many other materials will perform equally well with the present invention. For instance, at a slightly higher cost, titanium could be used as insert material with excellent results. A titanium insert is advantageous owing to its excellent impact response characteristics. In addition, because the insert is a hollow tube, the machining and cold working problems associated with titanium are minimized. The titanium insert provides a bat with an superb impact response, but at a cost vastly reduced from that of a solid titanium bat.

Furthermore, where cost is less a consideration, a titanium insert may be used within a titanium bat with outstanding results. It should be understood that various other metals, composite materials, plastics, and other materials may likewise perform equally as well with the present invention.

Many types of lubrication may be utilized with bats of the present invention. Varying the viscosity of the lubricant may modify the feel and response of such bats. In a preferred embodiment, a heavy grade of grease is used to accentuate the hydro-static effect of the grease during impact. Synthetic lubricants may be used as well as petroleum-based greases and oils. Equally good results may be also obtained from the use of lubricants such as Teflon TM. Moreover, insert and bat frame materials which are themselves slippery so as to permit the independent movement of insert and frame may work equally as well. Indeed, lubricant may be omitted entirely, so long as the resulting arrangement permits independent movement of insert and bat frame.

It will be recognized that the lubricant is a plastically deformable material. Plastic deformation of this material is restored by action of the bat frame and the insert. Certain advantages of the present invention can be achieved by substituting any plastically deformable material in the gap 26, irrespective of whether it is a lubricant.

In yet another embodiment of the invention, positive attachments of the insert 18 within the frame 11 may be dispensed with altogether. In this case, the insert would "float" on the layer of lubricant. An impact with a ball will cause the frame to deflect, thereby creating interference attachments for the insert 18 during impact. The swing of the bat during impact may tend to lodge the insert 18 in the end of the frame, contributing to an attachment. A bat with an insert held in this manner may respond much like a bat with an insert held at two interference fits. Furthermore, this alternative embodiment will also perform well when the lubricant is omitted.

In view of the many possible embodiments to which the principles of the present invention may be put, it should be recognized that the detailed embodiment is illustrative only and should not be taken as limiting the scope of the invention. Rather, I claim as my invention all such embodiments as may come within the scope and spirit of the following claims and equivalents thereto.

I claim:

1. A bat, comprising:

a hollow tubular bat frame having a circular cross-section; and an insert positioned within the frame, the insert having a circular cross-section, the insert having first and second ends adjoining the tubular frame, the insert being separated from the tubular frame by a gap forming at least part of an annular shape along a central portion between said first and second ends, the frame elastically deflectable across the gap to operably engage the insert along a portion of the insert between the insert first and second ends.

2. A bat according to claim 1 in which the insert is suspended within the frame and is secured thereto at said first and second ends.

3. A bat according to claim 2, wherein the insert is rigid and the gap is filled with a lubricant to facilitate the relative movement between the insert and the tubular frame when a ball is struck.

4. A bat according to claim 3, wherein the tubular frame has a small-diameter handle portion, an intermediate tapering portion, and a large diameter impact portion, and the insert is suspended within the frame impact portion.

5. A bat according to claim 4, wherein the insert is tubular.

6. A bat according to claim 5, wherein the gap thickness is small relative to the thickness of the impact portion wall and the insert wall.

7. A bat according to claim 6, with the tubular frame further having a reduced-diameter head portion atop the impact portion; and the first insert end being secured within the frame by a first interference fit within the tapering portion of the frame, and the second insert end being secured with the frame by a second interference fit within the head portion of the bat.

8. A bat according to claim 7, wherein the interference fits seal the lubricant within the gap.

9. A bat according to claim 8, wherein the insert is made of aluminum.

10. A bat according to claim 8, wherein the tubular frame is made of aluminum.

11. A bat according to claim 8, wherein the insert is made of titanium.

12. A bat according to claim 8, wherein the insert is made of composite material.

13. A bat according to claim 8, wherein the insert is made of steel.

14. A bat according to claim 10, wherein the lubricant is grease.

15. In a hollow bat having a small-diameter handle portion and a large-diameter impact portion, an improvement comprising an internal structural insert defining an annular gap with an inside wall of the impact portion of the bat and the impact portion elastically deflectable to close a portion of the annular gap and operably engage the insert.

16. The bat of claim 15 in which the gap is filled with a plastically deformable substance.

17. A bat, comprising:

a hollow tubular frame having a small diameter handle portion, an intermediate tapering portion, a large diameter impact portion, and a reduced-diameter head portion;

a tubular insert adapted to be suspended within the frame impact portion;

a first end of the tubular insert being received into the tapering portion and secured therein by a first interference fit;

a second end of the tubular insert being received by the head portion of the frame and secured therein by a second interference fit;

a gap separating the insert from the tubular frame, the gap extending from the first interference fit to the second interference fit, the gap being filled with grease to facilitate relative movement between the tubular frame and the insert when the bat strikes a ball; and the insert and the frame being made of aluminum.

18. A bat, comprising:

a hollow tubular bat frame having a small-diameter handle portion and a large-diameter impact portion having a circular cross-section with an inner and outer diameter;

at least one insert having a substantially circular cross-section with an outer diameter less than the inner diameter of the frame impact portion, the insert being held within the impact portion; and the impact portion being inwardly elastically deflectable such to establish a tight interference fit between the insert and the impact portion.

* * * * *